US006840784B2

(12) United States Patent
Chang

(10) Patent No.: US 6,840,784 B2
(45) Date of Patent: Jan. 11, 2005

(54) ADAPTER WITH FOLDAWAY PLUG COMPONENTS

(76) Inventor: Yung-Liang Chang, 3F, 128-11 Mingluen Rd, Ku Sun District, Kaohsiung (TW)

( * ) Notice: Subject to any disclaimer, the term of this patent is extended or adjusted under 35 U.S.C. 154(b) by 0 days.

(21) Appl. No.: 10/761,452

(22) Filed: Jan. 20, 2004

(65) Prior Publication Data

US 2004/0209500 A1 Oct. 21, 2004

(30) Foreign Application Priority Data

Jan. 24, 2003 (CN) ..... 3223325 U

(51) Int. Cl.[7] ..... H01R 13/44
(52) U.S. Cl. ..... 439/131
(58) Field of Search ..... 439/131, 171, 439/172, 528

(56) References Cited

U.S. PATENT DOCUMENTS 4,997,381 A * 3/1991 Oh ..... 439/131
5,713,749 A * 2/1998 Wu ..... 439/131
5,829,993 A * 11/1998 Wu ..... 439/131
6,042,400 A * 3/2000 Queffelec et al. ..... 439/131
6,062,880 A * 5/2000 Skuza ..... 439/131
6,126,460 A * 10/2000 Wu ..... 439/131
6,275,002 B1 * 8/2001 Chen ..... 439/131
6,398,566 B1 * 6/2002 Chen ..... 439/131
6,454,578 B1 * 9/2002 Yao ..... 439/131
6,494,727 B2 * 12/2002 Wen-Ching ..... 439/131

* cited by examiner

*Primary Examiner*—Tho D. Ta
(74) *Attorney, Agent, or Firm*—Westman, Champlin & Kelly, P.A.

(57) ABSTRACT

An adaptor with foldaway plug components comprising a shell and a plug components; said shell has a recess at its front end and said plug components is inserted into the recess of said shell; there are axle holes and at least three projected/pitted points in a circular line with the axle hole as the center of circle in certain radius in both sidewalls of the recess, in which at least one point is conductive; said plug components comprises a plug main body and a plug and said plug main body has rotation axles in both of its sidewalls. In both sidewalls of said plug there are pitted/projected points corresponding to the projected/pitted points, and at least one of such points is in integration with or in contact with said plug. Compared with the existing technology, the current invention has the following advantages: accurate positioning; good contact for conductive points; wide range of applications; wear resistance; long service life and easy manufacturing.

6 Claims, 2 Drawing Sheets

ADAPTER WITH FOLDAWAY PLUG COMPONENTS

The present application is based on and claims the benefit of Chinese patent application Serial No. 03223325.6, filed Jan. 24, 2003, the content of which is hereby incorporated by reference in its entirety.

FIELD OF INVENTION

This invention is directed to an electric plug, especially a portable adaptor with foldaway plug components.

BACKGROUND OF THE INVENTION

Together with developments in science and technology, there have emerged many kinds of portable electric appliances for users' convenience in travels and business trips, such as laptop computers, mobile phones and portable fax machines and etc. Power adaptor is one of the many indispensable spare parts for these portable electric appliances in use and it is being developed in the direction of small size, easiness in carrying and safe applications. There are already many kinds of adaptors with foldaway plugs on the markets, which meet customers' demands to some extent, but they have the following disadvantages: the plugs are in contact with the power output terminals inside the adaptors through metal spring strip in only one point Poor contact will occur during long-time usage and the contact will become heated even burned in case of heavy load of power; the plug orientation has only two points for positioning that are easily worn in long-time usage and thus cause loss of orientation function or error In orientation.

BRIEF SUMMERY OF THE INVENTION

The present invention is to avoid disadvantages in the prior art and present a new adaptor that has foldaway plug components with accurate positioning and good electric contact suitable for heavy load electric appliances.

The current invention adopts the following technical design:

Design and manufacture an adaptor with foldaway plug components that comprise a shell and plug components; said shell has a recess at the front end and the recess has axle holes on both of its sidewalls. At least three projected/pitted points are distributed in circle line formed around the center of the axle hole as the center of the circle in certain radius, among which at least one is a metal point to contact power output terminal in said shell; said plug components comprises a main body and a plug inserted into the main body. Said main body of plug has rotation an axle in both of its two side walls and pitted/projected points are set up in circle line with the rotation axles as the center of circle in correspondence to the projected/pitted points in the side walls of the recess in said main body of the plug components. At least one of said projected/pitted points is in integral or in contact with said plug; the rotation axles of said plug are inserted into the axle holes in sidewalls of the recess of said shell.

Compared with existing technology, the present invention of adaptor with foldaway plug components has the following advantages through multiple point contact and multiple positioning by projected and pitted points:

1. accurate positioning;
2. Good contacts of conductive points;
3. One or several conductive points can be set up as needed, being suitable for various electric appliances, including heavy load ones;

4. Wear resistant with long service life;
5. The present invention changes the existing separate design of conductive and positioning structures into an integrated design of both conductive and positioning structure for easy manufacture;
6. The current invention of adaptor can be used In different statuses based on the number of positioning points to match different power sockets.

BRIEF DESCRIPTION OF THE DRAWINGS

FIG. 1 is a sketch of structure of the present invention of adaptor with foldaway plug components, in which FIG. 1-1 is a sketch of the upper part 12 of said shell 1, FIG. 1-2 is a sketch of the base 13 of said shell 1 and FIG. 1-3 is a sketch of said plug components 2;

FIG. 2 is a sketch of said adaptor with foldaway plug components when the foldaway plug is in the recess 11 of the shell when not in usage;

FIG. 3 is a sketch to show a status in usage of said adaptor with foldaway plug components;

PREFERRED EMBODIMENT

Figures 1, 2, 3:
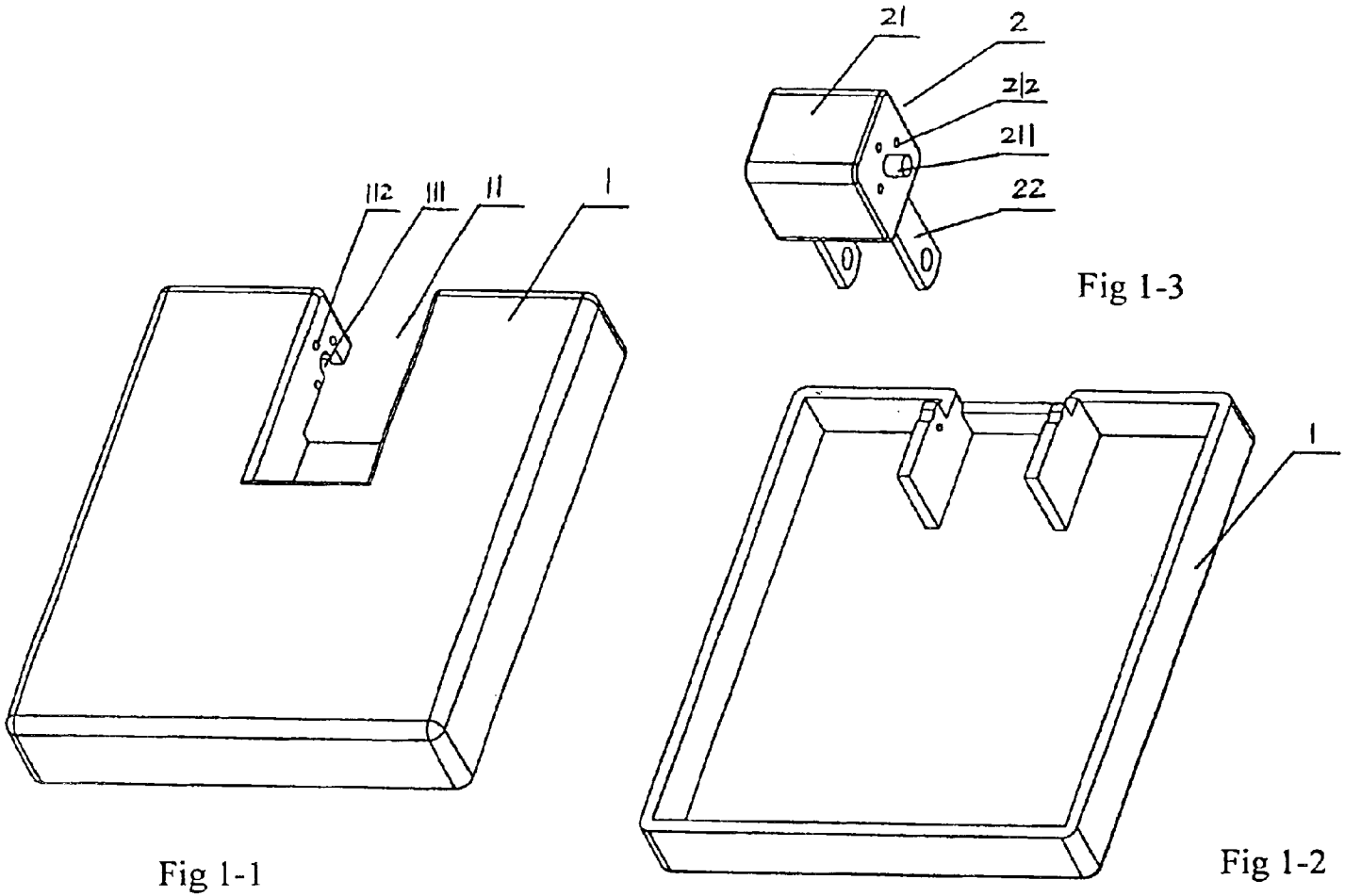
Figure 2:
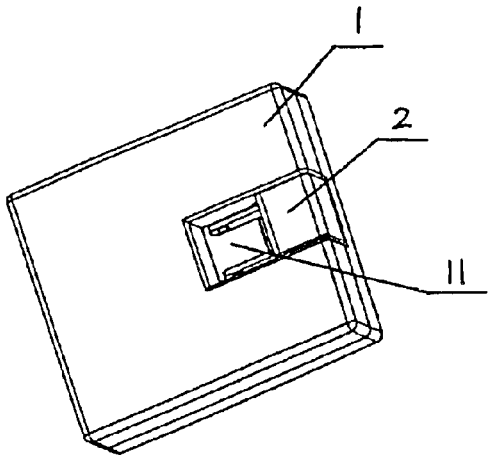
Figure 3:
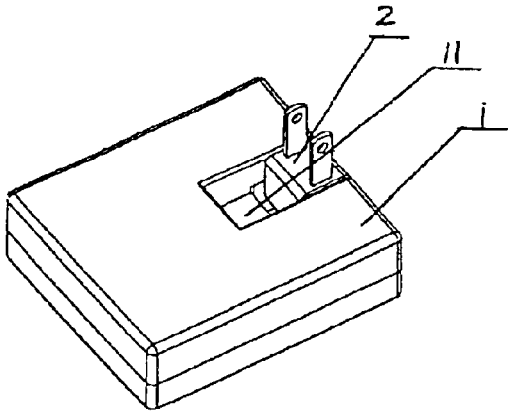

Further description of the current invention is given in the following In reference to the drawing.

As shown in FIG. 1 and FIG. 2, an adaptor with foldaway plug components comprises a shell 1 and plug components 2; said shell has an upper part 12 and a base 13. Said shell 1 has a recess 11 at its front end and there are axle holes 111 in both sidewalls of the recess 11, three projected/pitted points 112 are evenly distributed in a circle line with the axle hole 111 as the center of circle at a certain radius, in which at least one point is a metal point in contact with the power output terminal inside said shell 1; said plug components 2 comprises a plug body 21 and a plug 22 inserted into the main body 21; the main body of said plug components 21 has a rotation axle 211 in both of its sidewalls and there are pitted/projected points 212 in both sidewalls of said plug components 21 with the axis of the rotation axle 211 as the center of circle corresponding to the projected/pitted points 112 In the sidewalls of said recess 11; among the said projected/pitted points 212 there is at least one point is in integrity in contact with said plug 22; the rotation axles 211 of said plug components 2 are inserted into the axle holes 111 in the sidewalls of recess 11 of the shell 1. Projected/pitted points 112 in the sidewalls of said recess 11 and the corresponding pitted/projected points 212 in both sidewalls of said plug components 2 are made of elastic material. The rotation plug components 2 can realize transitions of the current invention from its working state to folding state (non-working state).

Figure 4:
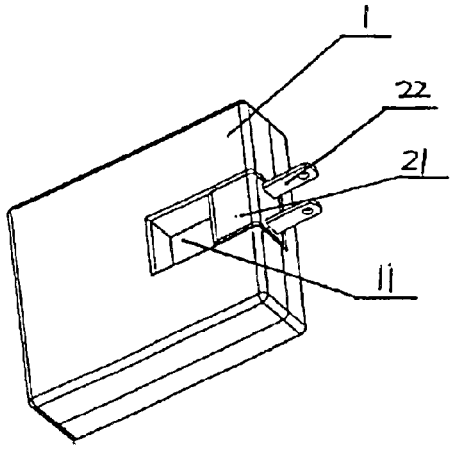
FIG. 4 is a sketch to show another status in usage of said adaptor with foldaway plug components.

As shown in FIG. 2 to FIG. 4, the end of said plug components 21 is flush with the front end of said shell 1 and the length of said recess 11 is a little bit longer than that of said plug components 2 and said rotation axles 211 are located just at the center of the sidewalls of said plug components 21 to make sure that said plug components 2 is able to rotate with an angle of 180° inside the recess 11 of the shell 1.

Folding state of the plug components 2 in the current invention is shown in FIG. 2 and said plug components 2 is folded into the recess 11 of said shell 1. In this case, the projected/pitted points 112 in both sidewalls of said recess 11 are disengaged with the corresponding pitted/projected points 212 in both sidewalls of said plug components 2.

Working state of the plug components 2 in the current invention is shown in FIG. 3. The rotation plug components 2 is now perpendicular to said shell 1 and in this case, the projected/pitted points 112 in both sidewalls of said recess 11 are engaged with the corresponding pitted/projected points 212 in both sidewalls of said plug components 2 and the elastic metal and non-metal points are now functioning as locators to make the current invention of adaptor maintain a stable condition of its plug in the working state.

Anther working state of the plug components 2 in the current invention is shown in FIG. 4. Said plug 22 is in the outside of said shell 1 and parallel to said shell 1. In this case, the projected/pitted points 112 in both sidewalls of said recess 11 are engaged with the corresponding pitted/projected points 212 in both sidewalls of said plug components 2 and the elastic metal points are contacting to conduct electricity and both the elastic metal and non-metal points are functioning as locators to maintain the current invention of adaptor in a stable condition in usage. This kind of relative location of the plug to the shell in working state is beneficial to saving space of power supply socket.

Number of the projected/pitted points 112 in both sidewalls of said recess 11 and the corresponding pitted/projected points 212 in said plug components 2 and number of conductive points in which are decided as actually needed, for example, in case of matching with heavy load electric appliances, two or three conductive points shall be set up.

As shown in FIG. 1, when the current invention is assembled, first place said plug components 2 into the base 13 of said shell 1 and then the upper cover 12 is put onto said plug and the base 13 to cover them.

What is claimed is:

1. An adaptor with foldaway plug components comprising a shell and plug components is featured by:

said shell has a recess at its front end and the recess has an axle hole and three projected/pitted points, which are distributed in a circle line with the center of the axle hole as the center of circle in a certain radius, in both of its sidewalls, at least one of the points is a metal point in contact with the power output terminal inside said shell;

said plug components comprise a main body and a plug inserted into the main body, said main body has a rotation axle in both of its sidewalls and there are pitted/projected points in both of its sidewalls of said plug components, which correspond to the projected/pitted points in sidewalls of said recess with the rotation axle as the center of circle, in both sidewalls of the main body, at least one of the pitted/projected points is in integrity or in electric contact with said plug; and the rotation axles of said plug components are inserted into the axle holes in sidewalls of the recess of said shell, and said plug components can rotate to different direction around its center to make conductive contact and positioning through the projected/pitted points in sidewalls of said recess contacting with the corresponding pitted/projected points in sidewalls of said plug components.

2. An adaptor with foldaway plug components as defined in claim 1 is featured by: projected/pitted points in sidewalls of said recess and the corresponding pitted/projected points in sidewalls of said plug components are made of elastic material.

3. An adaptor with foldaway plug components as defined in claim 1 is featured by: the end of said plug main body is flush with the front end of said shell (1).

4. An adaptor with foldaway plug components as defined in claim 1 is featured by: the length of said recess is a little bit longer than that of said plug components.

5. An adaptor with foldaway plug components as defined in claim 1 is featured by: said rotation axles are located just in the middle of both sidewalls of said main body.

6. An adaptor with foldaway plug components as defined in claim 1 is featured by: the projected/pitted points in said recess (11) and the corresponding pitted/projected points in said plug components (2) are evenly distributed in circle lines.

* * * * *